US009683425B2

(12) United States Patent
Hallundbæk et al.

(10) Patent No.: US 9,683,425 B2
(45) Date of Patent: Jun. 20, 2017

(54) DOWNHOLE INJECTION TOOL

(71) Applicant: WELLTEC A/S, Allerod (DK)

(72) Inventors: Jørgen Hallundbæk, Græsted (DK); Lars Stæhr, Glostrup (DK); Steffen Evertsen, Stavanger (NO)

(73) Assignee: Welltec A/S, Allerød (DK)

( * ) Notice: Subject to any disclaimer, the term of this patent is extended or adjusted under 35 U.S.C. 154(b) by 485 days.

(21) Appl. No.: 14/348,751

(22) PCT Filed: Sep. 27, 2012

(86) PCT No.: PCT/EP2012/069088

§ 371 (c)(1),
(2) Date: Mar. 31, 2014

(87) PCT Pub. No.: WO2013/045553

PCT Pub. Date: Apr. 4, 2013

(65) Prior Publication Data

US 2014/0238675 A1 Aug. 28, 2014

(30) Foreign Application Priority Data

Sep. 30, 2011 (EP) ..... 11183496

(51) Int. Cl.
*E21B 33/12* (2006.01)
*E21B 33/13* (2006.01)
(Continued)

(52) U.S. Cl.
CPC ..... *E21B 33/13* (2013.01); *E21B 33/124* (2013.01); *E21B 33/126* (2013.01); *E21B 33/134* (2013.01); *E21B 43/25* (2013.01)

(58) Field of Classification Search
None
See application file for complete search history.

(56) References Cited

U.S. PATENT DOCUMENTS 3,381,755 A 5/1968 Morrison
3,593,797 A 7/1971 Lebourg
(Continued)

FOREIGN PATENT DOCUMENTS

CN 2594447 Y 12/2003
CN 201883997 U 6/2011
(Continued)

OTHER PUBLICATIONS

International Search Report for PCT/EP2012/069088 mailed Jul. 16, 2013.

(Continued)

*Primary Examiner* — Caroline Butcher
(74) *Attorney, Agent, or Firm* — Nixon & Vanderhye P.C.

(57) ABSTRACT

A downhole injection tool has an injection unit with a first expandable cup adapted to provide a first seal against the inside wall, and a second expandable cup adapted to provide a second seal against the inside wall. The two cups, in an expanded state, together define an isolated zone of the annular space. At least one pipe element extends in a longitudinal direction between the two cups, the pipe element providing a fluid passage between an inlet arranged in one end of the pipe element and an outlet arranged in the pipe element in between the cups, the second expandable cup being slidably connected with the pipe element and displaced in the longitudinal direction away from the first expandable cup under the influence of the injection fluid injected into the isolated zone, whereby a distance d between the two cups is increased. The injection unit also has a retainer sleeve slidably arranged around the expandable cups to prevent unintentional expansion of the expandable cups during insertion of the downhole injection tool. The retainer sleeve is slidable in the longitudinal direction, and the (Continued)

expandable cups are released by movement of the retainer sleeve in the longitudinal direction.

16 Claims, 8 Drawing Sheets

(51) Int. Cl.

| | |
|---|---|
| ***E21B 33/124*** | (2006.01) |
| ***E21B 33/126*** | (2006.01) |
| ***E21B 33/134*** | (2006.01) |
| ***E21B 43/25*** | (2006.01) |

(56) References Cited

U.S. PATENT DOCUMENTS

| | | | | |
|---|---|---|---|---|
| 4,714,117 | A * | 12/1987 | Dech | E21B 17/00 166/187 |
| 5,803,177 | A | 9/1998 | Hriscu et al. | |
| 2006/0000620 | A1* | 1/2006 | Hamilton | E21B 43/26 166/387 |
| 2007/0227746 | A1* | 10/2007 | Xu | E21B 33/1216 166/387 |
| 2007/0261847 | A1 | 11/2007 | Saltel | |
| 2008/0190612 | A1* | 8/2008 | Buchanan | E21B 33/134 166/288 |
| 2009/0078405 | A1 | 3/2009 | Moore et al. | |
| 2010/0181079 | A1* | 7/2010 | Johnson | E21B 33/14 166/386 |
| 2010/0242586 | A1* | 9/2010 | Elshahawi | E21B 49/082 73/152.39 |
| 2012/0055671 | A1* | 3/2012 | Stromquist | E21B 33/126 166/298 |

FOREIGN PATENT DOCUMENTS

| | | |
|---|---|---|
| RU | 2 128 279 C1 | 3/1999 |
| RU | 2 389 864 C2 | 5/2010 |
| RU | 2 413 836 C2 | 3/2011 |
| WO | WO 2008/050103 | 5/2008 |

OTHER PUBLICATIONS

Written Opinion of the International Searching Authority mailed Jul. 16, 2013.

International Preliminary Report on Patentability issued in corresponding International Application No. PCT/EP2012/069088 dated Apr. 1, 2014.

* cited by examiner

DOWNHOLE INJECTION TOOL

This application is the U.S. national phase of International Application No.

PCT/EP2012/069088 filed 27 Sep. 2012 which designated the U.S. and claims priority to EP 11183496.6 filed 30 Sep. 2011, the entire contents of each of which are hereby incorporated by reference.

FIELD OF THE INVENTION

The present invention relates to a downhole injection tool for injecting an injection fluid into an annular space surrounding the downhole injection tool and enclosed by an inside wall of a borehole or a well tubular structure. Furthermore, the present invention relates to a downhole system comprising the downhole injection tool as well as to a method for casting a cement plug downhole.

BACKGROUND ART

In the field of hydrocarbon production, it is sometimes necessary to block the wellbore, e.g. to seal of part of the well. In substantially vertical wells, this may be done by setting some kind of plug and pouring cement into the well. When the cement cures, a plug in the wellbore is created. Depending on the materials used for creating the plug, it may be possible to drill through the plug to restore the flow path. Alternatively, the plug may be a permanent plug.

However, in deviated wells, it is not possible to cast a plug by simply pouring cement into the borehole. In deviated wells, such as wells having an inclination close to horizontal, the process of casting a plug is much more complicated.

Injection of a fluid such that the injected fluid fills up all of the available space of a section of the wellbore, either open or cased, is especially challenging in a deviated well inter alia due to gravity. If a plug is set in the well and a fluid is injected above the plug, the fluid will naturally level out in the well above the plug. If the well is highly deviated, it is practically impossible to make the fluid fill out a cross section of the wellbore. If the fluid is to fill out the cross section of the well over a section of the well, e.g. if a plug with a certain length is required, the task becomes even more difficult.

SUMMARY OF THE INVENTION

It is an object of the present invention to wholly or partly overcome the above disadvantages and drawbacks of the prior art. More specifically, it is an object to provide an improved downhole injection tool for injecting a fluid into a wellbore to fill up and fully block the wellbore.

The above objects, together with numerous other objects, advantages, and features, which will become evident from the below description, are accomplished by a solution in accordance with the present invention by a downhole injection tool for injecting an injection fluid into an annular space surrounding the downhole injection tool and enclosed by an inside wall of a borehole or a well tubular structure, the downhole injection tool comprising:

an injection unit comprising

- a first expandable cup adapted to provide a first seal against the inside wall,
- a second expandable cup adapted to provide a second seal against the inside wall,
- the two cups, in an expanded state, together defining an isolated zone of the annular space,

- at least one pipe element extending in a longitudinal direction between the two cups, the pipe element providing a fluid passage between an inlet arranged in one end of the pipe element and an outlet arranged in the pipe element in between the cups,
- the second expandable cup being slidably connected with the pipe element and displaced in the longitudinal direction away from the first expandable cup under the influence of the injection fluid injected into the isolated zone, whereby a distance d between the two cups is increased, wherein the injection unit further comprises a retainer sleeve being slidably arranged around the expandable cups to prevent unintentional expansion of the expandable cups during insertion of the downhole injection tool, the retainer sleeve is slidable in the longitudinal direction, and the expandable cups are released by movement of the retainer sleeve in the longitudinal direction.

In an embodiment, the injection unit may be adapted to be disconnected from the remainder of the downhole injection tool.

A length of the at least one pipe element may be adjusted according to the desired length of the isolated zone. Hereby, the length of a cement plug or the length of a section of the well exposed to the injected injection fluid may be adjusted according to specific needs.

Moreover, the retainer sleeve may comprise a first sleeve part and a second sleeve part movable in relation to one another.

The first sleeve part and the second sleeve part may have an internal diameter being smaller than a largest expanded outer diameter of the second expandable cup.

In addition, the first and second sleeve parts may comprise locking means for releasably interconnecting the first and second sleeve parts.

Furthermore, the locking means may comprise a snap mechanism constituted by one or more flexible elements attached to the second sleeve part, the one or more flexible elements being adapted to engage with a recess in an outer surface of the first sleeve part.

Also, the downhole injection tool may comprise breakable retainer elements adapted to prevent unintentional expansion of the expandable cups during insertion of the downhole injection tool in the well, the retainer elements being broken during expansion of the expandable cups.

In an embodiment, the downhole injection tool as described above may further comprise a fluid container in fluid communication with the pipe element, the fluid container containing the injection fluid to be injected into the isolated zone between the two cups via the pipe.

By the downhole injection tool comprising a fluid container, the downhole injection tool may be run on wireline, and the injection unit may be used in deep or deviated wells.

Additionally, the downhole injection tool as described above may further comprise a pump for forcing the injection fluid through the pipe element and into the isolated zone, the pump being in fluid communication with the annular space and fluidly connected to the fluid container to pump driving fluid from the annular space into the fluid container in order to squeeze the injection fluid out of the fluid container and into the pipe element.

By the downhole injection tool comprising a pump, the downhole injection tool may be run on wireline, and the injection unit may be used in deep or deviated wells.

Further, the fluid container may comprise a driving piston arranged inside the fluid container, the driving piston being movable in the longitudinal direction and displaceable by the driving fluid pumped into the fluid container by the pump, the driving piston comprising a driving piston locking mechanism adapted to prevent the driving piston from moving until a pressure inside the fluid container reaches a predetermined threshold value due to driving fluid being pumped into the fluid container.

The predetermined threshold for the pressure may be 0.5-3 bar excess pressure compared to the borehole pressure, preferably 0.5-1.5 bar excess pressure compared to the borehole pressure.

In an embodiment, the driving piston locking mechanism may comprise one or more spring biased pawls adapted to engage with a recess in a wall of the fluid container.

Also, the injection unit may further comprise an activation piston arranged inside the pipe element and connected with the retainer sleeve, the activation piston being movable upon injection of the injection fluid through the pipe element, whereby injection of the injection fluid moves the activation piston and the retainer sleeve in the longitudinal direction to release the expandable cups.

In addition, the activation piston may comprise an activation piston locking mechanism adapted to prevent the activation piston from moving until a pressure inside the fluid passage of the pipe element reaches a predetermined threshold value due to injection fluid being pumped into the injection unit.

Moreover, the predetermined threshold for the pressure may be 5-8 bar excess pressure compared to the borehole pressure, preferably 6-7 bar excess pressure compared to the borehole pressure.

Furthermore, the activation piston locking mechanism may be comprised by a cylindrical chamber provided in the activation piston, a slidable piston arranged in the cylindrical chamber, the locking piston being movable between a locking position and a release position and under the influence of a spring member arranged in the cylindrical chamber, and one or more locking elements slidably received in one or more radial bores in the activation piston, the one or more locking elements being locked in an extended position by the locking piston when the locking piston is in the locking position and slidable in a radial direction when the locking piston is displaced in the longitudinal direction towards the spring member by the injected injection fluid.

In an embodiment of the downhole injection tool according to the present invention, both the first and the second expandable cups may be slidably connected with the pipe element.

Additionally, the injection unit may comprise a check valve in fluid communication with the pipe element for preventing return flow of the injection fluid injected into the injection unit from the fluid container. The check valve is described in detail in the international patent application, international publication number WO 2008/085057, which is hereby incorporated by reference.

Also, the injection unit may be a casting unit for casting a cement plug downhole.

Further, the fluid container may be a cement bailer.

In addition, the injection unit may be a fluid treatment unit for exposing part of the well to a treatment fluid, such as an acid, cleaning fluid, etc.

Each of the expandable cups may comprise a connection element connected with the pipe element, a flexible sleeve having a first end connected with the connection element, and a plurality of spring elements arranged around the flexible sleeve to at least partly expand the flexible sleeve.

The downhole injection tool as described above may comprise an expansion mechanism adapted to expand the expandable cups downhole.

In an embodiment, the downhole injection tool may comprise shape memory alloys adapted to expand the expandable cups downhole.

Also, each of the expandable cups comprises an inflatable bladder encircling the pipe section.

Moreover, each of the expandable cups may further comprise a sealing material arranged along an edge in a second end of the flexible sleeve.

The downhole injection tool as described above may further comprise an ejection mechanism adapted to disengage the injection unit from the fluid container and thus from the remainder of the downhole injection tool, the ejection mechanism being activated when a pressure inside the fluid container reaches a predetermined threshold value due to driving fluid being pumped into the fluid container.

Furthermore, the predetermined threshold for the pressure may be 2-7 bar excess pressure compared to the borehole pressure, preferably 2-5 bar excess pressure compared to the borehole pressure.

Additionally, the ejection mechanism may comprise a cylindrical housing, one or more locking pawls, a piston sleeve slidably arranged inside the cylindrical housing and movable between a locking position and a release position, and a spring member pushing the piston sleeve in the longitudinal direction, the locking pawls being slidably received in one or more radial bores in the cylindrical housing and locked in an extended position by the piston sleeve when the piston sleeve is in the locking position and slidable in a radial direction when the piston sleeve is displaced in the longitudinal direction towards the spring member by the injected driving well.

Also, the piston sleeve of the ejection mechanism may be displaced in the longitudinal direction towards the spring member by the driving piston engaging with the piston sleeve to block the flow through the piston sleeve.

In an embodiment, the downhole injection tool may comprise an electrical motor powered through a wireline for driving the pump.

Further, the driving fluid may be a well fluid drawn in from the annulus surrounding the downhole injection tool.

The present invention also relates to a downhole system comprising the downhole injection tool as described above and a downhole tractor connected to one end of the downhole injection tool, the tractor being adapted to push the downhole injection tool into the borehole before the expandable cups are released and the injection fluid injected.

The present invention further relates to a method for casting a cement plug downhole using the downhole injection tool as described above, the method comprising the steps of:

lowering the downhole injection tool into a well, pumping a driving fluid into the downhole injection tool, whereby the injection fluid is displaced and the retainer sleeve is moved in the longitudinal direction to release the expandable cups, and injecting the injection fluid into the isolated zone of the annular space, whereby the distance between the two cups is increased.

The driving fluid may be a well fluid drawn in from the annulus surrounding the downhole injection tool.

The method for casting a cement plug downhole may further comprise the step of disconnecting the injection unit from the remainder of the downhole injection tool.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figures 1A, 1B, 1C:
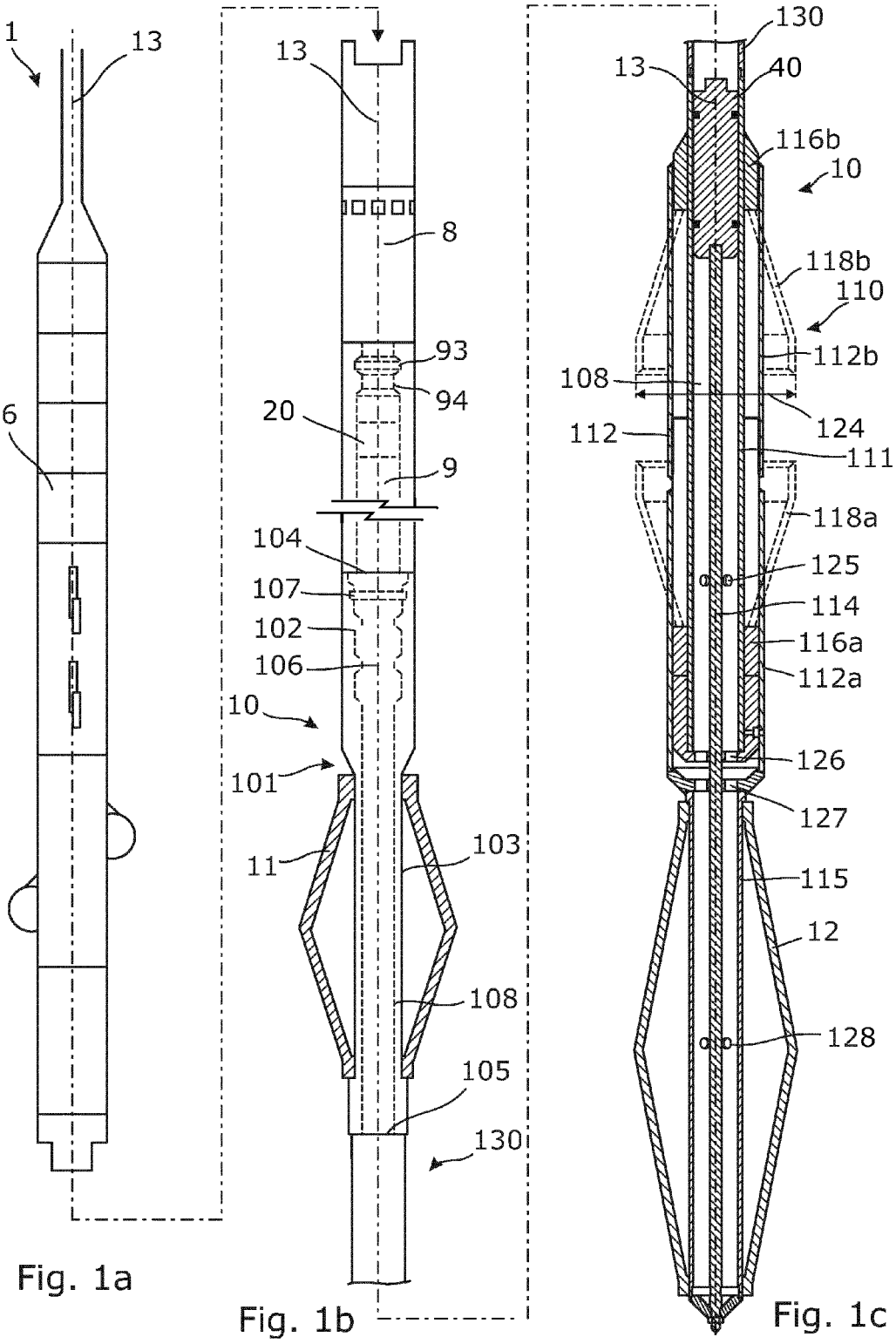
FIGS. 1*a*-1*c* show the downhole injection tool according to an embodiment of the invention.
Figure 8:
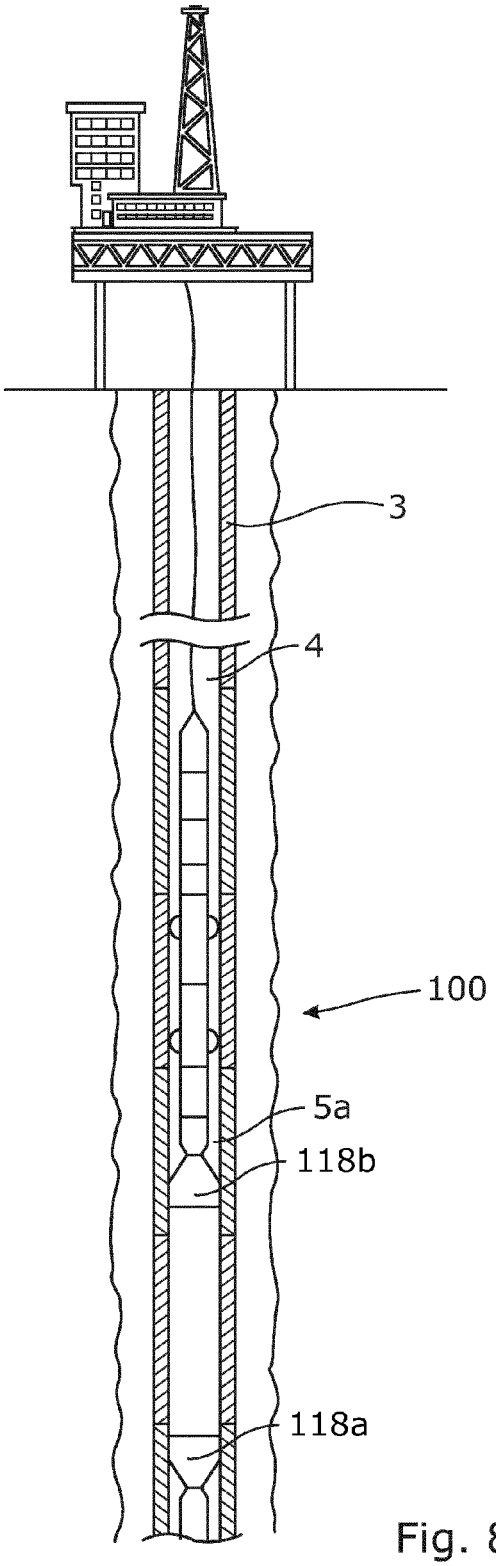
FIG. 8 shows a downhole system comprising the downhole injection tool according to an embodiment of the invention.

FIGS. 1*a*-1*c* show a downhole injection tool 1 comprising a downhole tractor section 6 for pushing the downhole injection tool forward in a well, a pump 8 for pumping a driving fluid into the downhole injection tool, a fluid container 9 containing an injection fluid to be injected downhole, and an injection unit 10 through which the injection fluid is injected into a well 4, as shown in FIG. 8. As indicated by the dotted lines, the tool sections shown in FIGS. 1*a*, 1*b* and 1*c* are to be connected into one coherent tool string constituting a downhole system 100, as shown in FIG. 8.

The injection unit 10 extends in a longitudinal direction 13 and comprises a first section 101 through which the injection unit is connected to the fluid container 9 and thus the remainder of the downhole injection tool. From an inlet 104 arranged in the first section of the injection unit, a fluid passage 108 extends to a second section 110 of the injection unit. Towards the inlet 104, the first section has a wider part 102 in which a check valve 106 and a recess 107 are provided for engaging with an ejection mechanism of the fluid container. Towards a second end 105 of the first section 101, a length 103 of reduced diameter for accommodating a centraliser mechanism 11 is provided. Various types of centraliser mechanisms are known to those skilled in the art, and further details of the centraliser will not be disclosed. The second end 105 of the first section is connected to an intermediate pipe section 130 connecting the first and the second section of the injection unit 10. The length of the intermediate pipe section 130 may be varied according to the specifications of the specific job to be carried out. The intermediate pipe section 130 is connected with a pipe element 111 of the second section 110, whereby fluid communication is established between the first and the second section of the injection unit 10. Surrounding the pipe element 111, a first expandable cup 118*a* and second expandable cup 118*b* are provided. In FIG. 1*c*, the expandable cups 118*a*, 118*b* are shown in an extended position indicated by the dotted lines. When the downhole injection tool 1 is lowered into the well 4, the expandable cups 118*a*, 118*b* are kept in a compact position (not shown) by a retainer sleeve 112. The retainer sleeve 112 is arranged around the expandable cups 118*a*, 118*b* to restrict the expandable cups from extending in a radial direction. At one end of the retainer sleeve 112, a tubular part 115 is provided. The tubular part 115 has a reduced diameter similar to the length 103 of the first section 101 for accommodating a second centraliser mechanism 12. Inside the pipe element 111, an activation piston 40 is provided. The activation piston 40 is connected with the retainer sleeve 112 via a rod 114 extending between the activation piston 40 and the tubular part 115. By displacing the activation piston 40, the tubular part 115 and the retainer sleeve 112 are displaced in the longitudinal direction 13. The fluid passage 108 extending through the injection unit 10 fluidly connects the inlet 104 with one or more outlets 125 provided in the pipe element 111 between the expandable cups 118*a*, 118*b*. In one end of the pipe element 111, further fluid openings 126 are provided for providing fluid communication with an inside of the tubular part 115 through fluid openings 127. In the tubular part 115, one or more fluid orifices 128 are arranged for providing fluid communication between an annular space 5*a* surrounding the downhole injection tool and the inside of the tubular part 115 and a part of the pipe element 111 below the activation piston 40, when regarded as in FIG. 1*c*.

Figure 2A:
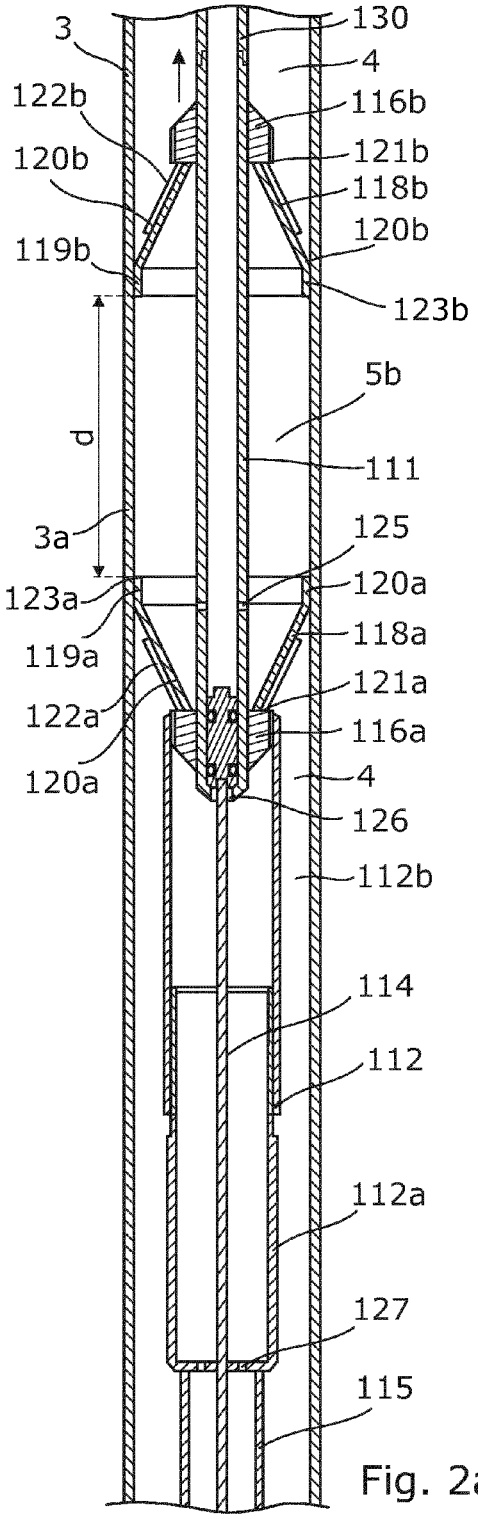
FIG. 2*a* shows an injection unit with two expandable cups in an expanded position.
Figure 2B:
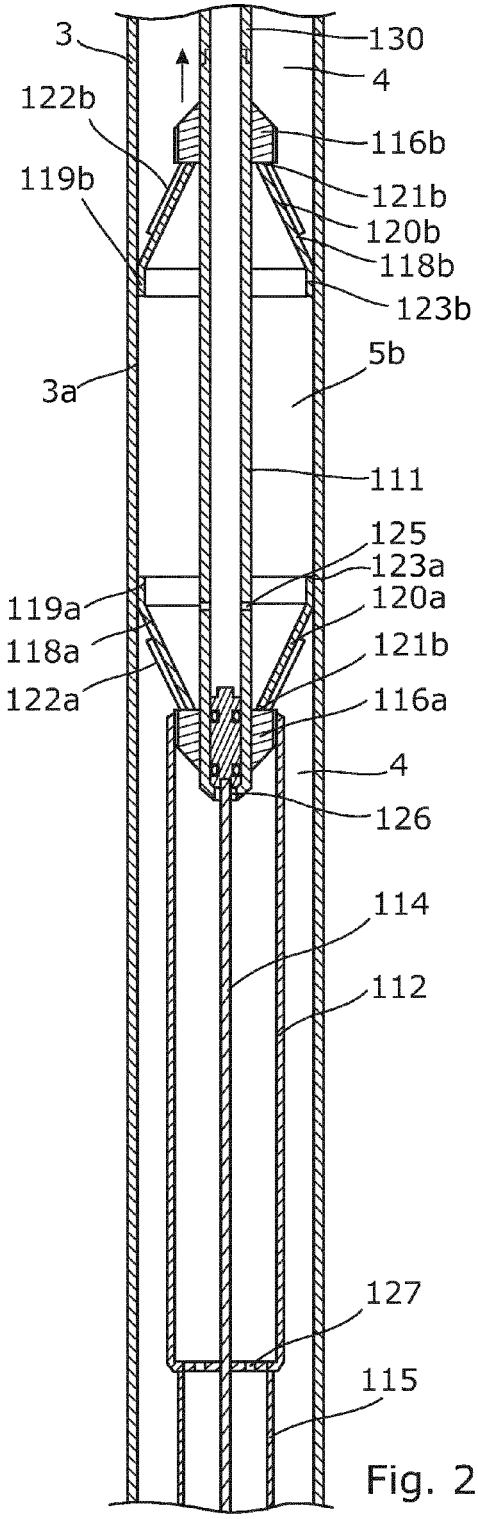
FIG. 2*b* shows another injection unit with two expandable cups in an expanded position.
Figure 3:
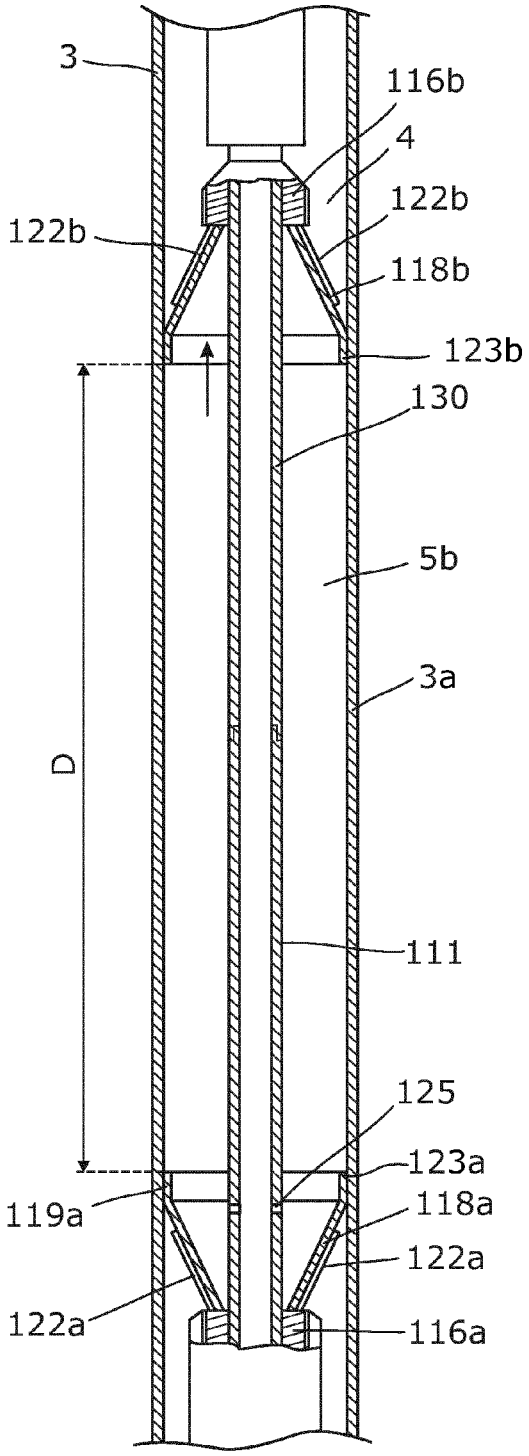
FIG. 3 shows the injection unit with the second expandable cup displaced in the longitudinal direction.

The first expandable cup 118*a* and the second expandable cup 118*b* are adapted to provide a first seal 119*a* and a second seal 119*b*, respectively, against an inside wall 3*a* of a borehole or well tubular structure 3, as shown in FIG. 8. When in the extended position, the expandable cups together define an isolated zone 5*b* of the annular space. Each of the expandable cups comprises a connection element 116*a*, 116*b* connected with the pipe element 111, a flexible sleeve 120*a*, 120*b* having a first end 121*a*, 121*b* connected with the connection element, and a plurality of spring elements 122*a*, 122*b* arranged around the flexible sleeve to at least partly expand the flexible sleeve. When in the extended position, a free end 123*a*, 123*b* of the flexible sleeves 120*a*, 120*b* abuts the inside wall 3*a* of the borehole or well tubular structure 3, as shown in FIGS. 2*a*, 2*b* and 3. The free ends 123*a*, 123*b* of each of the flexible sleeves may be provided with a sealing material, such as foam rubber but not limited hereto, for enhancing the adaptability of the expandable cups and providing an increased sealing effect between the flexible sleeves 120*a*, 120*b* and the inside wall 3*a* of the borehole or well tubular structure 3.

It is to be understood by those skilled in the art that the expandable cups may be constructed in a number of different ways without departing from the scope of the present invention.

Before inserting the downhole injection tool into the well, injection fluid is poured into the fluid container 9 and the first section 101 and the intermediate pipe section 130 of the injection unit. The injection fluid is poured into the tool through an opening positioned below the check valve 106 in FIG. 1*b* so that when the first section 101 and the intermediate pipe section 130 of the injection unit are filled with injection fluid and when the pressure in the injection fluid increases to a certain level, the check valve 106 opens so that also the fluid container 9 is filled with injection fluid. Air present in the tool before filling the escapes through an outlet in one end of the fluid container 9 opposite the check valve. When the fluid container 9, the first section 101 and the intermediate pipe section 130 are filled with injection fluid, the opening and the outlet are closed.

Subsequently, the downhole injection tool is inserted into the well, and when the downhole injection tool has been positioned in the well 4 by operating the downhole tractor section 6, the pump 8 is activated to pump driving fluid into the downhole injection tool 1 from the annular space 5*a*. The pump 8 is in fluid communication with the fluid container 9, and the driving fluid is forced into the fluid container to squeeze out the injection fluid contained therein. Inside the fluid container 9, a driving piston 20 is provided to separate the driving fluid and the injection fluid, thereby preventing intermixture of the two. The driving fluid displaces the driving piston 20 in the longitudinal direction 13 to squeeze the injection fluid contained in the fluid container 9 into the injection unit 10 through the check valve 106. The check valve is a dual check valve opening in a first direction at one excess pressure or over-pressure and opening in the direction opposite the first direction at another excess pressure. Hereby, the total volume of injection fluid is squeezed through the injection unit 10. When the injection fluid is sufficiently pressurised, the activation piston 40 is displaced in the longitudinal direction 13, thereby displacing the retainer sleeve 112. As the activation piston 40 is displaced through the pipe element 111, well fluid present in the pipe element 111 on the side of the activation piston 40 opposite the injection fluid is displaced out through the fluid openings 126. As the activation piston reaches the end of the pipe element 111, the retainer sleeve is fully displaced, and the expandable cups have been extended in the radial direction to provide an isolated zone 5*b*, as shown in FIGS. 2*a* and 2*b*. Further, due to the activation piston 40 being adequately displaced in the longitudinal direction, the fluid outlets 125 are in fluid communication with the fluid passage 108, and the injection fluid exits the pipe element 111 through the fluid outlets 125 and pours into the isolated zone 5*b* between the expandable cups. As the driving piston 20 continues in the longitudinal direction through the fluid container 9, injection fluid is continuously injected into the isolated zone 5*b*. As the amount of injection fluid in the isolated zone 5*b* increases, the second expandable cup 118*b* being slidably connected with the pipe element 111 is displaced in the longitudinal direction away from the first expandable cup 118*a*, as shown in FIG. 3. Hereby, an initial distance d between the two cups shown in FIGS. 2*a* and 2*b* is increased to a distance D, as shown in FIG. 3, to increase the length and volume of the isolated zone 5*b*. Depending on the length of the intermediate pipe section 130 and the amount of injection fluid contained in the fluid container 9, the length of the isolated zone may be designed according to specific needs. Due to the injection fluid being squeezed or injected into the isolated zone 5*b* under a certain pressure, the injection fluid fills up the isolated zone even though the downhole injection tool is operated in a highly deviated well. This is due to that fact that the slidable second expandable cup is not moved until the isolated zone is filled up with injection fluid and is only moved by the injection fluid. The inside wall 3*a* of the borehole or the well tubular structure 3 throughout the isolated zone 5 is thus in contact with or subjected to the injection fluid.

It is to be understood by those skilled in the art that the downhole injection tool according to an embodiment of the invention may also be inserted into the well without the use of a downhole tractor. Further, the downhole injection tool may be used as a wireline tool, as shown in FIG. 8, or on coiled tubing or the like, whereby the driving fluid and/or the injection fluid may be provided from the surface of the well.

To be able to control when the expandable cups are extended and the injection fluid injected, the driving piston 20 and the activation piston 40 are provided with pressure-sensitive locking mechanisms 21, 41. The driving piston 20 shown in FIGS. 4*a* and 4*b* comprises a driving piston body 25 and one or more driving piston locking mechanisms 21 adapted to prevent the driving piston from moving until a pressure P1 inside the fluid container 9 reaches a predetermined threshold value due to the driving fluid being pumped into the fluid container 9. Each of the driving piston locking mechanisms 21 comprises pawls 22 movably received in a radial bores 24 in the piston body 25 and under the influence of a spring member 23. The pawls are adapted to engage with a recess 93 in an inside wall of the fluid container shown in FIG. 1*b*. The one or more driving piston locking mechanisms 21 are arranged in a narrowing part of the driving piston fitting into a corresponding narrowing part 94 of the fluid container. When the driving piston is positioned in the narrowing part 94, the spring biased pawls 22 engage with the recess 93 to lock the driving piston. When the pump starts to pump driving fluid into the downhole injection tool, a pressure P1 on the side of the driving piston 20 opposite the injection fluid increases until the pawls 22 are pushed out of the recess 93 and the driving piston is released. In one embodiment, the driving piston 20 is released when the pressure P1 reaches 1-3 bar excess pressure compared to the borehole pressure. Alternatively, the driving piston 20 may be released when the pressure P1 reaches approximately 1 bar excess pressure compared to the borehole pressure.

Figure 5:
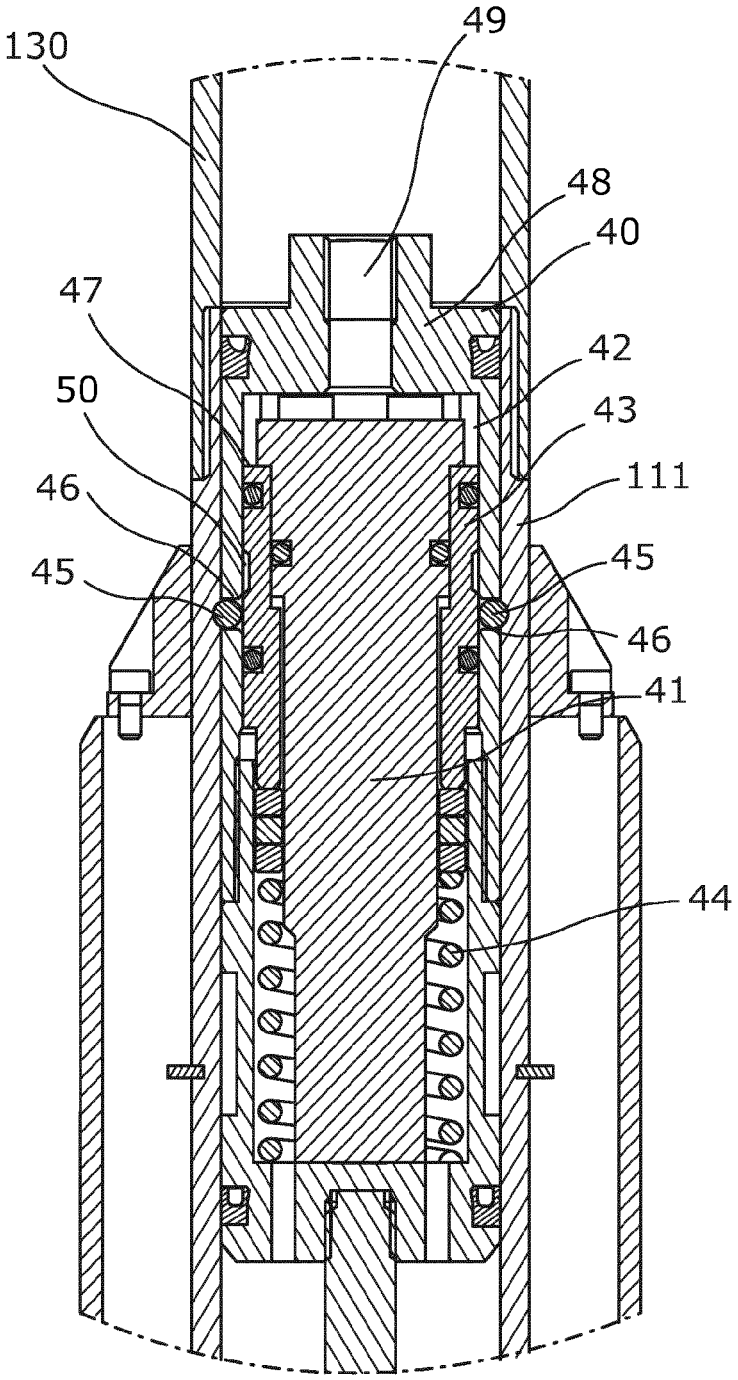
FIG. 5 shows the activation piston and the activation piston locking mechanism.
Figure 6:
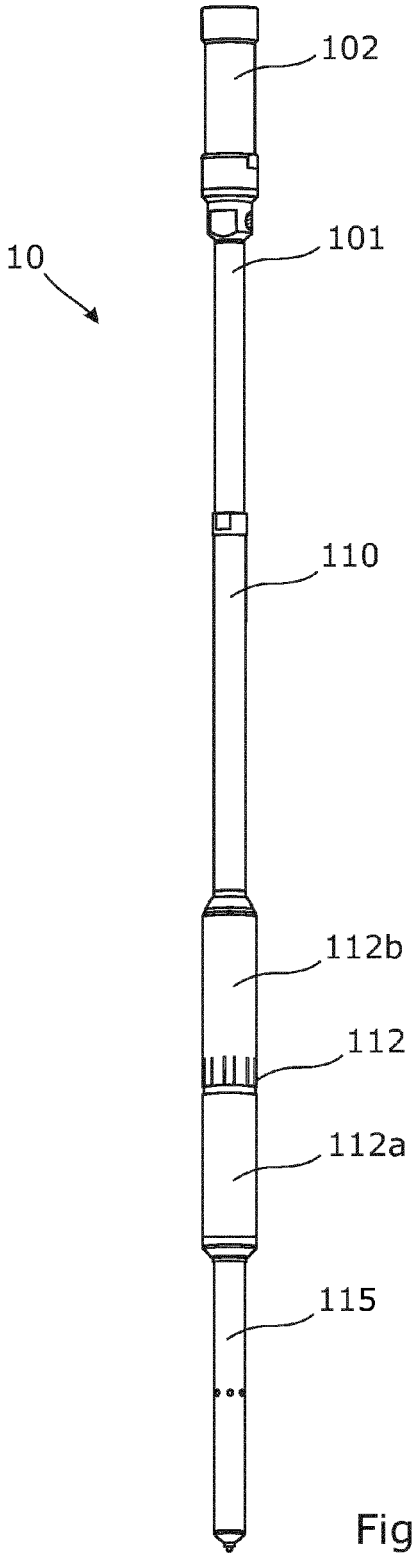
FIG. 6 shows the injection unit according to an embodiment of the invention.

For a similar purpose, the activation piston 40 shown in FIG. 5 comprises an activation piston locking mechanism 41 adapted to prevent the activation piston 40 from moving until a pressure P2 inside the fluid passage of the pipe element 111 reaches a predetermined threshold value due for displacement of injection fluid. The activation piston 40 comprises a piston body 48 having a cylindrical chamber 42 and a slidable locking piston 43 arranged in the cylindrical chamber. The locking piston is movable between a locking position and a release position and under the influence of a spring member 44 arranged in the cylindrical chamber. One or more locking elements 45 are slidably received in one or more radial bores 46 in the piston body 48. When the locking piston 43 is in the locking position, as shown in FIG. 5, the one or more locking elements 45 are locked in an extended position. By contrast, when the locking piston 43 is displaced in the longitudinal direction towards the spring member 44, a circumferential recess 50 in an outer surface of the locking piston 43 is positioned adjacent the one or more radial bores 46, thereby rendering the locking elements 45 slidable in a radial direction. When the locking piston is in the release position and the locking elements may slide, the activation piston is released and displaceable by the injection fluid. The locking piston 43 is moved into the release position by the injection fluid being displaced. The injection fluid enters the cylindrical chamber 42 through a central opening 49 in the piston body 48 and exerts a force on a face 47 of the locking piston. In one embodiment, the activation piston is released when the pressure P2 reaches 5-8 bar excess pressure compared to the borehole pressure. Alternatively the activation piston may be released when the pressure P2 reaches 6-7 bar excess pressure compared to the borehole pressure.

Figure 7:
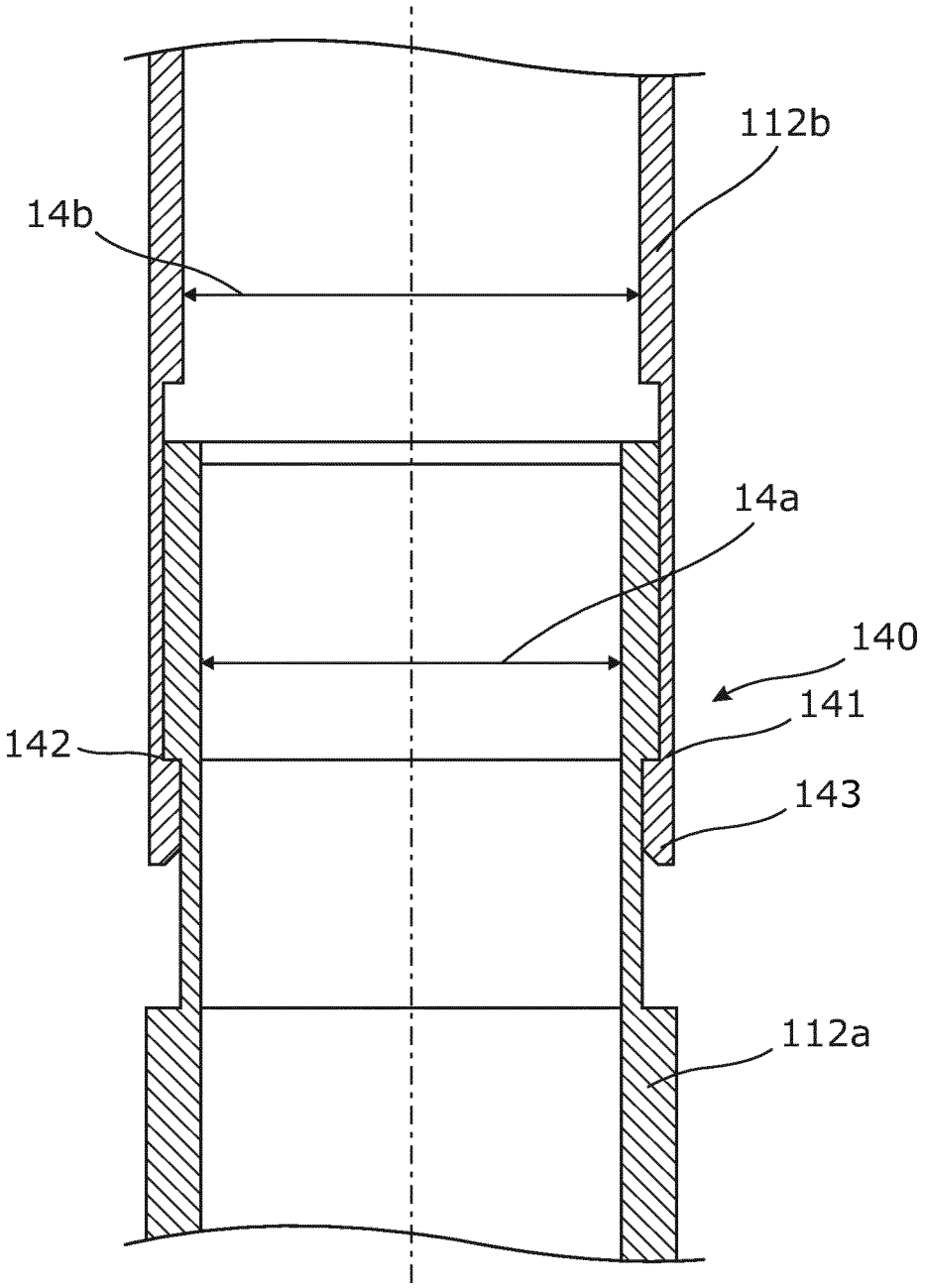
FIG. 7 shows the first retainer sleeve part and the second retainer sleeve part and the appertaining locking means.

FIG. 2*a* shows a retainer sleeve 112 comprising a first sleeve part 112*a* and a second sleeve part 112*b* movable in relation to one another. The first and the second sleeve part comprise a locking means 140 for releasably interconnecting the first and the second sleeve part, as shown in FIG. 7. The locking means comprises a snap-lock mechanism constituted by one or more flexible arm elements 141 attached to the second sleeve part 112*b*. The one or more flexible arm elements 141 comprise(s) a protrusion 143 adapted to engage with a recess 142 in an outer surface of the first sleeve part, whereby the first and the second sleeve part interlock. By the retainer sleeve 112 being divided into two separate sleeve parts, the assembly process of the injection unit is improved. Before the injection unit is mounted on the remainder of the downhole injection tool and inserted into the well, the expandable cups 118*a*, 118*b* have to be compressed into the compact position described earlier. For this purpose, the first sleeve part has an internal diameter 14*a* and the second sleeve part has an internal diameter 14*b*, as shown in FIG. 7, which internal diameters are smaller than a largest expanded outer diameter of the expandable cups. By having two separate sleeves, the first sleeve part 112*a* may, before mounting, be positioned with one end around the connection element 116*a* and extending away from the flexible sleeve 120*a*, and the second sleeve part 112*b* may be positioned with one end around the connection element 116*b* and extending away from the flexible sleeve 120*b*. Hereby, when the sleeve parts are drawn towards each other, the expandable cups 118*a*, 118*b* are forced into a compact position, and the first and the second sleeve part may be interconnected to form a coherent retainer sleeve 112. FIG. 2*b* shows another embodiment of the injection unit comprising a one piece retainer sleeve 112.

Figure 4A:
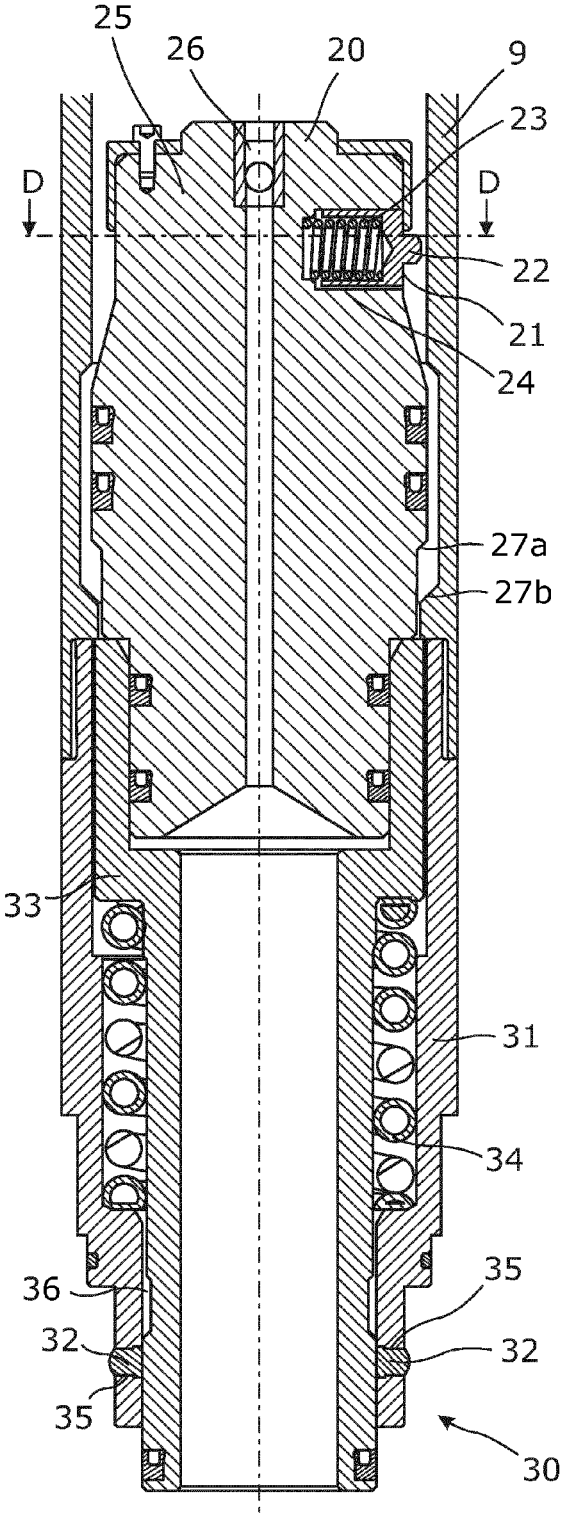
FIG. 4*a* shows the driving piston positioned in the bottom of the fluid container.
Figure 4B:
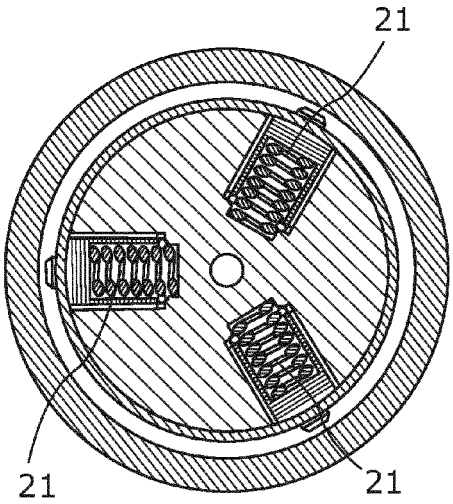
FIG. 4*b* shows a cross section of FIG. 4*a* along line D-D.

The downhole injection tool 1 further comprises an ejection mechanism 30, partly shown in FIG. 4*a*. The ejection mechanism 30 is adapted to disengage the injection unit from the fluid container 9 and thus from the remainder of the downhole injection tool. In the shown embodiment, the ejection mechanism 30 itself is arranged between the fluid container 9 and the injection unit 10 and co-operates with a recess 107 in an inner wall of the injection unit 10 shown in FIG. 1*b*. In an alternative embodiment, the ejection mechanism may, however, be integrated in a bottom part of the fluid container or in the injection unit. As shown in FIG. 4*a*, the ejection mechanism 30 comprises a cylindrical housing 31 threadedly connected with the fluid container 9 and a piston sleeve 33 slidably arranged inside the cylindrical housing 31 and movable between a locking position and a release position. The ejection mechanism further comprises a spring member 34 pushing the piston sleeve in the longitudinal direction, and one or more locking pawls 32 are slidably received in one or more radial bores 35 in the cylindrical housing. The locking pawls 32 are locked in an extended position by the piston sleeve 33 when the piston sleeve is in the locking position. By contrast, when the piston sleeve 33 is displaced in the longitudinal direction towards the spring member, a circumferential recess 36 in an outer surface of the piston sleeve 33 is positioned adjacent the one or more radial bores 35, thereby rendering the locking pawls 32 slidable in a radial direction. When the piston sleeve 33 is in the release position and the locking elements may slide, the injection unit may be disengaged from the remainder of the downhole injection tool.

During injection of the injection fluid, the driving piston 20 moves through the fluid container 9 to squeeze injection fluid into the injection unit 10. When the driving piston 20 has been pushed through the fluid container in the longitudinal direction and the fluid container is empty, the driving piston 20 engages with the piston sleeve 33 of the ejection mechanism 30, as shown in FIG. 4*a*. Hereby, the fluid communication between the fluid container 9 and the injection unit 10 is blocked, and by continuing to pump driving fluid into the fluid container 9, a pressure P3 inside the fluid container will rise. The piston sleeve 33 is displaced due to the force exerted on the piston sleeve 33 by the driving fluid being pumped into the fluid container. When the pressure P3 reaches a predetermined threshold value, the piston sleeve 33 slides into the release position, and the injection unit may be disengaged. In one embodiment, the ejecting mechanism is activated by the piston sleeve being displaced when the pressure P3 reaches 2-7 bar excess pressure compared to the borehole pressure, preferably 2-5 bar excess pressure compared to the borehole pressure. Due to the substantial excess pressure in the fluid container 9, the activation of the ejection mechanism results in the driving piston 20 being displaced a bit further, corresponding to a distance between a tapering portion 27*a* of the driving piston and a corresponding tapering portion 27*b* of an inside wall of the fluid container. Hereby, the injection unit 10 is ejected or pushed away from the fluid container 9, and the remainder of the downhole injection tool may be retrieved to the surface of the well.

The pressure of the injection fluid varies inside the tool during the filling and injection processes, respectively. Firstly, the injection fluid is filled into the container at an excess pressure of 1-5 bar, and secondly, the driving fluid is pumped into the injection tool to exert a force on driving piston locking mechanisms 21 that releases the driving piston at en excess pressure of 0.5-2 bar. Subsequently, the driving piston moves, thereby building up the pressure in the injection fluid until an excess pressure of maximum 4 bar is reached and the dual check valve opens, whereby the injection fluid passes the check valve. Then the pressure of the injection fluid inside the injection unit is increased and reaches an excess pressure of 5-8 bar, the activation piston locking mechanism 41 is released, and the activation piston 40 displacing the retainer sleeve is activated. Then, the injection fluid is injected into the annulus between the cups, and the pressure of the injection fluid drops substantially. The driving piston moves until the fluid container 9 is empty, and the pressure increases again until it reaches an excess pressure of 2-5 bar, whereupon the ejection mechanism 30 is released and the injection unit is released from the rest of the tool.

By the driving piston locking mechanisms 21, the activation piston locking mechanism 41 and the ejection mechanism 30 being released at 0.5-3 bar, 5-8 and 2-5 bar, respectively, it is secured that the various operating steps of the downhole injection tool are performed in the correct sequence. However, it is to be understood by those skilled in the art that various other combinations of the pressure of P1, P2, and P3 may be applied to achieve the desired effect of releasing the locking mechanism and the ejection mechanism in the prescribed sequence.

Referring to FIG. 1*b*, the previously described check valve 106 arranged in the fluid passage 108 adjacent the inlet 104 of the injection unit 10 is provided to prevent injection fluid injected into the injection unit 10 from escaping through the inlet 104 when the injection unit has been separated from the remainder of the downhole injection tool.

In the above description, the fluid to be injected into the annulus has been referred to as the injection fluid, without regard to specific fluid properties. The downhole injection tool may be used for injecting various types of injection fluids, such as but not limited to cement slurry, an acid solution or a cleaning fluid.

If the downhole injection tool is used in combination with a cement slurry, the fluid container may be referred to as a cement bailer, and the injection unit may be used as a casting unit for casting a cement plug downhole. When casting a cement plug, the downhole injection tool 1 is operated in a manner similar to what has been described above. When the driving piston 20 has squeezed the cement slurry out of the fluid container or cement bailer, the injection unit is disengaged from the fluid container, and the casting unit is left downhole for the cement slurry to cure. When the cement slurry has cured, the injection unit is permanently fixed inside the borehole or well tubular structure, and a cement plug has been created. Depending on the material properties of the injection unit, the cement plug may subsequently be drilled away to re-establish a fluid passage past the cement plug.

Alternatively, the downhole injection tool may be used as a fluid treatment tool for exposing part of the well to a treatment fluid, such as an acid solution, cleaning fluid, etc. During such use, it may not be necessary to disengage the injection unit 10 from the fluid container 9, or the injection unit may be left inside the borehole or well tubular structure for shorter or longer periods of time. When operated as part of a fluid treatment tool, the injection unit may be referred to as a fluid treatment unit.

By expansion of the expandable cups is meant that each of the cups is expandable as a whole. The expandable cups may be constructed from parts not being individually expanded, but the design of the cups and the interconnected parts make the cups expandable as a whole. Expansion of the expandable cups may also be regarded as the expandable cups being unfolded.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the tools are not submergible all the way into the casing, a downhole tractor can be used to push the tools all the way into position in the well. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole injection tool for injecting an injection fluid into an annular space surrounding the downhole injection tool, enclosed by an inside wall of a borehole or a well tubular structure, the downhole injection tool comprising:

an injection unit comprising a first expandable cup adapted to provide a first seal against the inside wall, a second expandable cup adapted to provide a second seal against the inside wall, the two cups, in an expanded state, together defining an isolated zone of the annular space, at least one pipe element extending in a longitudinal direction between the two cups, the pipe element providing a fluid passage between an inlet arranged in one end of the pipe element and an outlet arranged in the pipe element between the cups, the second expandable cup being slidably connected with the pipe element and displaced in the longitudinal direction from an initial axial position to a displaced axial position away from the first expandable cup under the influence of the injection fluid injected into the isolated zone, whereby a distance d between the two cups is increased, wherein the injection unit further comprises a retainer sleeve being slidably arranged around the expandable cups to prevent unintentional expansion of the expandable cups during insertion of the downhole injection tool, and wherein the retainer sleeve is slidable in the longitudinal direction and the expandable cups are released by movement of the retainer sleeve in the longitudinal direction, wherein the first and second expandable cups are maintained in a radially compressed position within the retainer sleeve during insertion of the downhole injection tool and the cups are deployed to expand to radially expanded positions in sealing contact with the inside wall when the retainer sleeve is moved, and wherein the second expandable cup is configured to maintain sealing contact with the inside wall as the second expandable cup slides from the initial axial position to the displaced axial position.

2. A downhole injection tool according to claim 1, wherein the retainer sleeve comprises a first sleeve part and a second sleeve part movable in relation to one another.

3. A downhole injection tool according to claim 1, further comprising a fluid container in fluid communication with the pipe element, the fluid container containing the injection fluid to be injected into the isolated zone between the two cups via the pipe.

4. A downhole injection tool according to claim 3, further comprising a pump for forcing the injection fluid through the pipe element and into the isolated zone, the pump being in fluid communication with the annular space and fluidly connected to the fluid container to pump driving fluid from the annular space into the fluid container in order to squeeze the injection fluid out of the fluid container and into the pipe element.

5. A downhole injection tool according to claim 4, wherein the fluid container comprises a driving piston arranged inside the fluid container, the driving piston being movable in the longitudinal direction and displaceable by the driving fluid pumped into the fluid container by the pump, the driving piston comprising a driving piston locking mechanism adapted to prevent the driving piston from moving until a pressure inside the fluid container reaches a predetermined threshold value due to driving fluid being pumped into the fluid container.

6. A downhole injection tool according to claim 3, further comprising an ejection mechanism adapted to disengage the injection unit from the fluid container and thus from the remainder of the downhole injection tool, the ejection mechanism being activated when a pressure inside the fluid container reaches a predetermined threshold value due to driving fluid being pumped into the fluid container.

7. A downhole injection tool according to claim 6, wherein the ejection mechanism comprises a cylindrical housing, one or more locking pawls, a piston sleeve slidably arranged inside the cylindrical housing and movable between a locking position and a release position, and a spring member pushing the piston sleeve in the longitudinal direction, the locking pawls being slidably received in one or more radial bores in the cylindrical housing and locked in an extended position by the piston sleeve when the piston sleeve is in the locking position and slidable in a radial direction when the piston sleeve is displaced in the longitudinal direction towards the spring member by the injected driving well.

8. A downhole injection tool according to claim 7, wherein the piston sleeve of the ejection mechanism is displaced in the longitudinal direction towards the spring member by the driving piston engaging with the piston sleeve to block the flow through the piston sleeve.

9. A downhole injection tool according to claim 1, wherein the injection unit further comprises an activation piston arranged inside the pipe element and connected with the retainer sleeve, the activation piston being movable upon injection of the injection fluid through the pipe element, whereby injection of the injection fluid moves the activation piston and the retainer sleeve in the longitudinal direction to release the expandable cups.

10. A downhole injection tool according to claim 9, wherein the activation piston comprises an activation piston locking mechanism adapted to prevent the activation piston from moving until a pressure inside the fluid passage of the pipe element reaches a predetermined threshold value due to injection fluid being pumped into the injection unit.

11. A downhole injection tool according to claim 10, wherein the activation piston locking mechanism is comprised by a cylindrical chamber provided in the activation piston, a slidable piston arranged in the cylindrical chamber, the locking piston being movable between a locking position and a release position and under the influence of a spring member arranged in the cylindrical chamber, and one or more locking elements slidably received in one or more radial bores in the activation piston, the one or more locking elements being locked in an extended position by the locking piston when the locking piston is in the locking position and slidable in a radial direction when the locking piston is displaced in the longitudinal direction towards the spring member by the injected injection fluid.

12. A downhole injection tool according to claim 1, wherein each of the expandable cups comprises a connection element connected with the pipe element, a flexible sleeve having a first end connected with the connection element, and a plurality of spring elements arranged around the flexible sleeve to at least partly expand the flexible sleeve.

13. A downhole system comprising the downhole injection tool according to claim 1 and a downhole tractor connected to one end of the downhole injection tool, the tractor being adapted to push the downhole injection tool into the borehole before the expandable cups are released and the injection fluid injected.

14. A method for casting a cement plug downhole using the downhole injection tool according to claim 1, the method comprising:

lowering the downhole injection tool into a well, pumping a driving fluid into the downhole injection tool, whereby the injection fluid is displaced and the retainer sleeve is moved in the longitudinal direction to release the expandable cups into sealing contact with the inside wall, and injecting the injection fluid into the isolated zone of the annular space, whereby the distance between the two cups is increased while the two cups maintain sealing contact with the inside wall.

15. A method according to claim 14, further comprising disconnecting the injection unit from the remainder of the downhole injection tool.

16. A downhole injection tool according to claim 1, wherein each of the cups includes at least one spring element to bias the cups to the radially expanded positions.

* * * * *